US011060817B2

(12) United States Patent
Bowmar

(10) Patent No.: US 11,060,817 B2
(45) **Date of Patent: *Jul. 13, 2021**

(54) BOWMAR NOSE BUTTON

(71) Applicant: Josh Bowmar, Ankeny, IA (US)

(72) Inventor: Josh Bowmar, Ankeny, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/820,394

(22) Filed: Mar. 16, 2020

(65) Prior Publication Data

US 2020/0217615 A1 Jul. 9, 2020

Related U.S. Application Data

(63) Continuation-in-part of application No. 16/378,480, filed on Apr. 8, 2019, now Pat. No. 10,591,244.

(60) Provisional application No. 62/775,283, filed on Dec. 4, 2018.

(51) Int. Cl.
*F41G 1/467* (2006.01)
*F41B 5/14* (2006.01)

(52) U.S. Cl.
CPC ..... *F41G 1/467* (2013.01); *F41B 5/14* (2013.01); *F41B 5/148* (2013.01); *Y10T 428/139* (2015.01); *Y10T 428/1393* (2015.01); *Y10T 428/1397* (2015.01)

(58) Field of Classification Search
CPC . F41G 1/467; F41B 5/148; F41B 5/14; Y10T 428/1393; Y10T 428/139; Y10T 428/1397
See application file for complete search history.

*Primary Examiner* — Michael C Miggins

(57) ABSTRACT

An archery aiming aid clips to a bow string and may be fixed at a position along the string so that an archer may draw the bow such that the bead contacts the archer's nose. The nose button provides an exact point of contact for the archer to place his or her face on the string in the exact same spot every time. The nose button improves accuracy in shooting because its extremely precise locatability on the archers face at full draw enables a consistent, repeatable anchor point, which is the face to string contact being established in exactly the same way every time.

20 Claims, 4 Drawing Sheets

BOWMAR NOSE BUTTON

CROSS REFERENCE TO RELATED APPLICATION

This non-provisional utility application is a continuation-in-part of non-provisional utility application Ser. No. 16/378,480 "Bowmar Nose Button," filed 8 Apr. 2019 and currently pending.

Non-provisional utility application Ser. No. 16/378,480 "Bowmar Nose Button," filed 8 Apr. 2019, claims the benefit of and priority to U.S. Provisional Patent Application 62/775,283 "Nose Button" filed 4 Dec. 2018 and now expired.

The entire contents of U.S. Provisional Patent Application 62/775,283 "Nose Button" filed 4 Dec. 2018, and the entire contents of non-provisional utility application Ser. No. 16/378,480 "Bowmar Nose Button," filed 8 Apr. 2019 are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to an aiming aid for target archery and bow hunting.

BACKGROUND

In archery, the point of impact of an arrow and its tip is influenced by several simultaneous parameters, most notably the amount of stored mechanical potential energy converted to arrow velocity, and the elevation angle at which the arrow is launched.

Accuracy in archery is gained by repeated visceral learning experiences of which muscle positions of the entire body result in which ranges and impact points of the arrows. According to some techniques, an archer sights along an arrow shaft, but in other techniques the arrow axis at launch is offset from a line of sight from the archer's aiming eye to the target or to an aiming structure on the bow, arrow, or string, so that the repeatable control of a launch angle must also be learned by experience and muscle memory which is not often or easily transferable from one bow and arrow system to another, nor easily transferable from one user to another user of the same system. Thus, despite its ancient history, many challenges for repeatability and reproducibility remain unsolved in the field of archery, and opportunities abound for inventive accessories and improvements which overcome traditional limitations.

BRIEF DESCRIPTION

Many existing sighting aids for archery help correlate distance of impact only to an elevation angle at which a bow is held, but without regard to depth of draw of the bow string. A "sight picture" is composed of a visual image or view of the bow parts and arrow parts in the near field combined with the view of the target at a distance.

It is disadvantageously possible for a user of an archery sighting system to create the same "sight picture" while the energy stored in the bow varies, which results in the same sight picture yielding different arrow impact points. It is therefore a primary objective of the invention to provide a new "anchoring" device for the archer, that uses the nose to provide tactile feedback to assist in aiming.

Another objective of the invention is to provide means by which an archer may repeatably draw a particular point on the bow string to a particular point on the shooter's nose, providing that other variables such as arrow length and mass are reasonably similar. Extreme precision in establishing an anchor point of a particular point on the bow string to a particular point on the shooter's nose advantageously results in extreme accuracy for the shooter.

A corollary objective of the invention is to enable a user to reestablish the same relative positions of the bow, the eye, the arrow and its tip, and any sighting structures in the vicinity of the grip or arrow rest, so that whenever these components are organized the same way by using the same anchor point for a previous shot with the same arrow, then the same point of impact for the arrow may be expected and achieved.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION of CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Although archery for sport, for hunting to procure food, and for waging war predates written history, accessories and methods have developed and evolved over time and new inventions continually contribute to and improve the art and skill of archery, beginning with the basics of storing mechanical energy in a bow, temporarily coupling a nock of an arrow to the bow, resting a forward portion of the arrow on a portion of the bow, and releasing the stored energy so that it is transferred into substantially longitudinal acceleration of the arrow, which then flies to a target or intended point of impact and is usually stabilized while in flight.

The invention is an anchoring device that aids the archer in consistent, precise string to face contact. A consistent anchor point is the most important factor for accuracy in archery.

Figure 1:
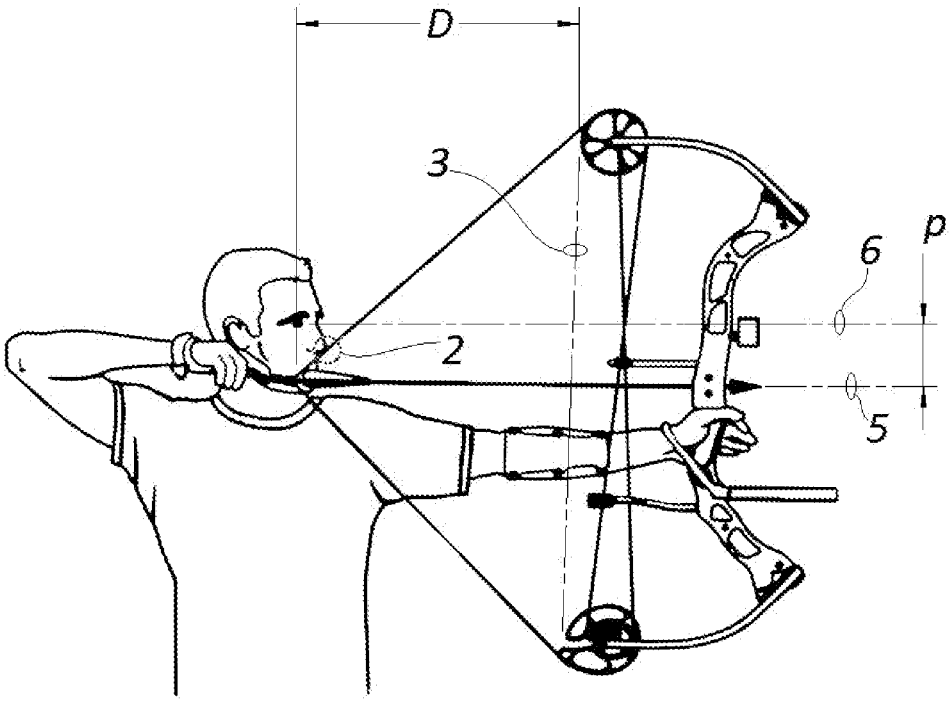
FIG. 1 shows a bow in a drawn position to geometry of improved, accurate archery as enabled by using a nose button in accordance with the invention.

FIG. 1 shows an archer holding a bow in a drawn position and using some contemporary archery accessories, including an arm guard and a wrist release. Phantom line [3] represents a bow string in a slack position, and dimension 'D' defines a depth of draw from the slack position to a drawn position when the archer will be visually aiming the bow and its nocked arrow. Draw stops are available in modern archery which allow the archer to draw back the bow string to the exact same distance from one shot to the next. Typically the line of sight [6] from the archer's eye to the target is offset from the longitudinal axis [5] defined by a nocked and drawn arrow. Axis [5] may also be called the shooting axis of the bow. The line of sight and the arrow's axis are nearly parallel in most cases except in extreme distance shooting or other unusual circumstances, so that a linear dimension of parallax 'p' may be defined between these axes [5] and [6.]

It is possible to draw the bow string to a point where a part of the string touches the user's nose. If a wrist release or an arrow nock grasps the bow string at a uniform and repeatably locatable point along its length, then, when the archer fully extends his or her forearm which grips the bow, and if the bow may be drawn to a repeatable point of contact between the string and the shooters face, and if the parallax can be repeatably re-established, then the entire geometry defining an amount of stored energy to be transferred to the arrow and the relationship between the archer's line of sight and the impact point of the arrow may also be repeatably controlled from one shot to the next. More important, because of the great sensitivity of the skin of the nose to even slight variations of a point of contact on the nose, extreme accuracy may be developed by learning to bring an anchor point on the string to the same exact point on the nose, shot after shot.

Another repeatable constraint of the above is to nock the arrow at the same point of the bow. Some archers mark more than one position along a bow string for nocking an arrow to define a variety of launch angles for a drawn arrow.

The second constraint is to store the same amount of mechanical potential energy available to be transferred to the arrow from one shot to the next. The invention aids in solving this second constraint by establishing a repeatably identifiable point on the bow string, to which the bow is drawn until draw stops indicate a full draw has been achieved. The drawn bow is then positioned so that the nose button touches the archer's nose. Reference numeral [2] illustrates such a contact point of the bow string touching an archer's nose.

Modern archery includes many accessories and new features which simplify or eliminate age-old problems. These include subassemblies with many moving parts. Modern bows include draw stops which allow the archer to draw back the bow string to the exact same distance every single time. By using the inventive nose button, archer accuracy has been observed to be improved sixfold over unimproved methods not using the invention.

The invention comprises an archery aiming aid which clamps onto a bow string at a position whereby an archer may draw the bow and then position it so that the bead contacts the archer's nose. Using a nose button in accordance with the invention, an archer is able to hold a bow in a repeatable configuration or geometry comprising outstretched limbs and relative positions of the hands, the bow grip, the depth of draw of the bow string, the apex of the drawn bow string and an arrow nocked therein, and other factors relating to the mechanical energy stored in the bow and imparted to the arrow when released.

The invention may be used for a traditional bow wherein the stored energy varies greatly with the depth of draw, but it is moreover directed to improve the use of modern compound bows. Compound bows have cams which turn over at a particular and repeatable point along the draw length where the draw force drops off noticeably, so that the same amount of energy may be stored whenever an archer draws the bow string to that same break point in draw force. The drawn bow may then be brought into contact so that the anchor point indicated by the radial points of the nose button contact a particular point on the shooter's nose.

With practice, an archer is able to build tactile memory of the anchor point, which is the point of contact on the nose of a particular point along the bow string, so that from one shot to the next the archer may repeatably re-establish the same geometry in the body and bow, and repeatably re-establish the same parallax between the archer's line of sight and the shooting axis of the bow, so that improved uniformity of trajectories is achieved, point of impact is learned and controlled more accurately, and thus the archer's accuracy and effectiveness is increased. The use of a nose button firmly mounted to a bow string greatly aids in re-establishing the geometrical parameters of stored energy and parallax of the archer and bow. The human nose is able to discern a repeatable contact point on the nose to within 1 mm (about 0.040 in) of locational accuracy. The repeatability of establishing an anchor point on the nose underpins all the other factors involved with sending an arrow where it is wanted to go.

For maximum accuracy while using the invention for shooting a bow and arrow, an archer establishes a set of consistent set of "anchor points," which are points of contact with the archer's face. Contact with a taut bow string and the face can create an ambiguous contact sensation when more than a small portion of the string lays along or embeds into the flesh of the face, because the contact interface becomes a long ellipse instead of a small, focused point. The inventive nose button offers a best mode "anchor point" for an archer to repeatedly achieve the exact same facial contact point shot after shot, and solves both the problem of inconsistent parallax between the archers line of sight and the shooting axis of the bow, and the problem of storing a consistent amount of stored energy in the bow from shot to shot. Extreme precision in establishing an anchor point of a particular point on the bow string to a particular point on the shooter's nose advantageously results in extreme accuracy for the shooter. In comparison to the width of an unadorned bow string touching the nose, the locational accuracy of detecting the protuberant points of the invention may be enhanced by about 3.25 times more precision because the width of the contact point of the nose button to the face is less than 1 mm.

Figure 2:
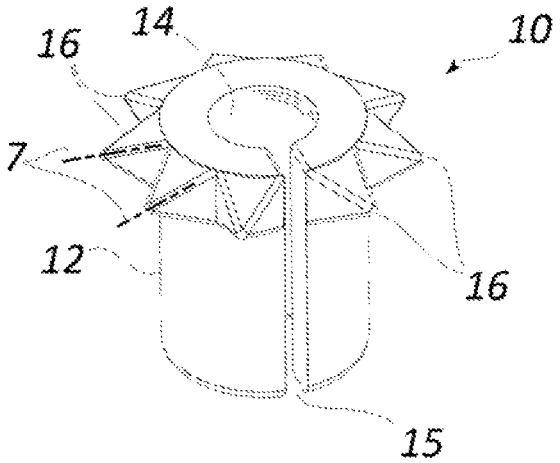
FIG. 2 shows an embodiment of a nose button in accordance with the invention.

FIG. 2 shows an embodiment of a nose button [10] in accordance with the invention. The bead comprises an open seam tube [12] that defines a longitudinal axis. An open seam tube in this specification is also called a split tube and it is a tube with is a split, gap, or a slit [15] that extends over its the entire length. The bead has an interior passage or lumen [14] which also extends the entire length of the bead. A radially spaced array of radial projections [16] extend radially outward and substantially perpendicular to the longitudinal axis of the bead. Each projection further defines its own axis of projection [7,] and in a preferred embodiment in accordance with the invention, the radial projections all lie in a plane perpendicular to the longitudinal axis of the split tube, so that regardless of the twist of the bow string or the angular orientation of the bead, when the bow string is drawn and all other parameters are re-established, the bow will shoot the arrow so that it will fly to a predictable and repeatable point of impact.

It is preferred that the radial projections have at least one portion which tapers along its axis of projection, so as to minimize the size of the contact area between the bead and the archer's face, which maximizes accuracy by allowing the archer to learn to feel for the location of a small point of contact on the face with finer resolution, which allows more accurate sensation and control of the anchor point. In a best mode use, the nose button is adjusted to a point on the bow string so that it contacts a point on the archer's nose. A projection may taper to a frustum, which in this specification means a face of smaller area than the root contact of the projection to the tube, or it may taper to a point or a rounded or blunted point. Thus a "projection" as used in this specification may also be referred to as a spike or a stud. A projection may also lack a taper and may extend at constant cross section from its root to its tip. A cylindrical, square, polygonal, elliptic, or other constant cross section may be used as a projection in accordance with the invention. A projection may also transition from one cross section to another along any portion of its length. Tapering projection may also be alternated among projections having a constant cross section. For projections not having a taper, a "tip" as used in claim 1 and elsewhere may be taken to mean an exit point on an end face of its contour of projection.

Figure 3:
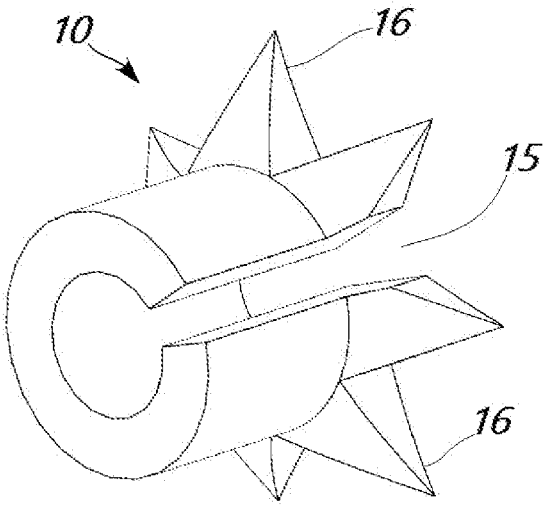
FIG. 3 shows an alternative embodiment of a nose button in accordance with the invention.

FIG. 3 shows an alternative embodiment of a nose button [10] in accordance with the invention. The radial projections [16] are located at an end of the open seam tube. The open seam tube has a gap [15] running along its entire length. The radial projections in this have a root width dimension and the projections each converging to an apex, and in a preferred embodiment each apex resides in a plane perpendicular to said longitudinal axis. The projections may be four-sided pyramids or other polygon cross sections. A projection may also be a cone having a round or elliptical cross section, and may taper to an apex or be a frustum having an end face.

The number of radial projections around the nose button is preferably at least three. Although the embodiment illustrated here shows seven arranged in a circumference, a radial array comprising a larger number of projections is also within the scope of the invention.

Figure 4A:
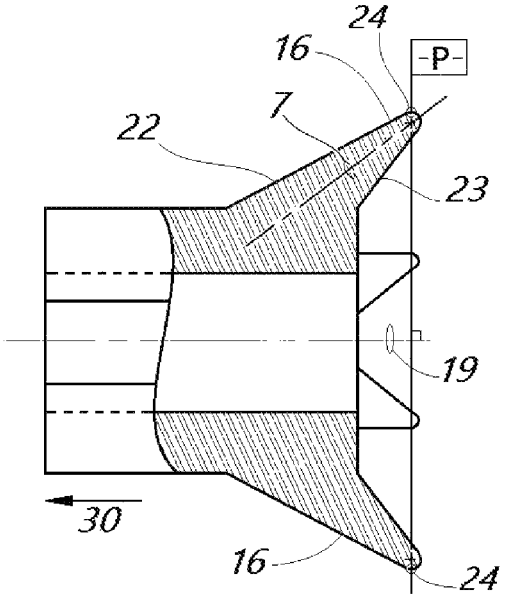
FIG. 4*a* shows a cross section of another alternative embodiment of a nose button in accordance with the invention.

FIG. 4*a* shows a cross section of another alternative embodiment of a nose button in accordance with the invention. The points of the projections [16] in this style come to blunted or rounded ends, and the tip of a projection for blunted or rounded forms such as these is taken as the point [24] at the tip of the projections which is most distant from the longitudinal axis [19] defined by the open seam tube. The tips of these projections as defined all reside in a plane [P] which is perpendicular to the longitudinal axis, which also defines a forward direction shown by arrow [30.]

For the discussion of this and other figures, the arrow [30] defines a "forward" direction along the longitudinal axis to be applied where ever terms such as "ahead," "behind," "forward," "forward facing" "in front of," "aft," "abaft," "rear," "rearward facing," and "after" are used in this specification.

Forward facing portions of the projections of this embodiment all share a common first conical surface [22] and rearward facing portions of these projections also share a common second conical surface [23.] Each projection defines an axis of projection [7] and the cross sections of the projections taper along at least a portion of their axis of projection, where in this specification the words "taper," and "tapering" include any reduction in cross sectional area of a projection with increasing distance from the longitudinal axis of the tube.

The axis of projection is not necessarily perpendicular to the longitudinal axis of the open seam tube. In this embodiment all axes of projection would lie in a common cone. It is also possible to make projections such as round rods or square bars which do not taper at all along their axes of projection, although it is preferable that the projections actually do taper to an apex or a sharp point for most sensitive detection of their location during contact with a users' nose.

Figure 4B:
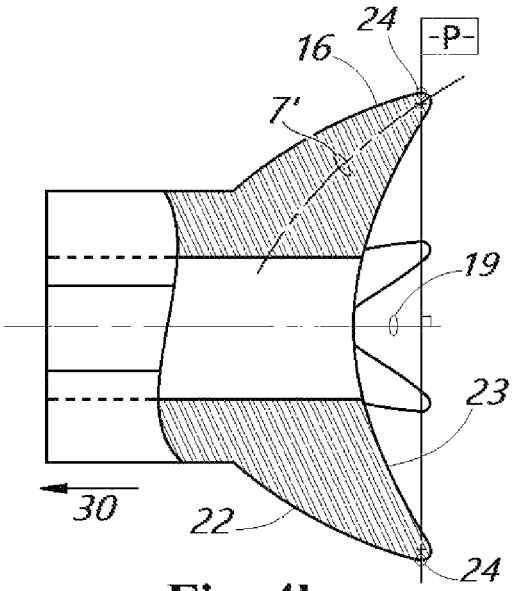
FIG. 4*b* shows a cross section of another alternative embodiment of a nose button in accordance with the invention.

FIG. 4*b* shows a cross section of another alternative embodiment of a nose button in accordance with the invention, wherein surfaces of the projections [16] comprise a sector of a sphere. The arrow [30] defines a "forward" direction along the longitudinal axis. Both the forward facing surfaces [22] and the rearward facing surfaces [23] are spherical surfaces. The forward facing surfaces are positively curved (as in the outside of a ball) and the rearward facing surfaces are negatively curved (as in the inside of a hollow ball.) All the forward facing surfaces of all the projections preferably have the same first spherical radius and are concentric to a first center point, and all the rearward facing surfaces of all the projections preferably also have the same second spherical radius and are concentric to a second center point. As seen in this example, an axis of projection [7'] may also be defined as a curve or contour rather than a straight line. Therefore in examples such as these, the projection cross section may taper along a contour of projection, rather than along an axis of projection. The projection cross section is taken in a section plane perpendicular to the contour of projection. The tip of a projection for blunted or rounded forms such as these is taken as the point [24] at the tips of the projections, which for each are the points most distant from the longitudinal axis [19] defined by the open seam tube. The tips of these projections as defined all reside in a plane [P] which is perpendicular to the longitudinal axis.

Figure 4C:
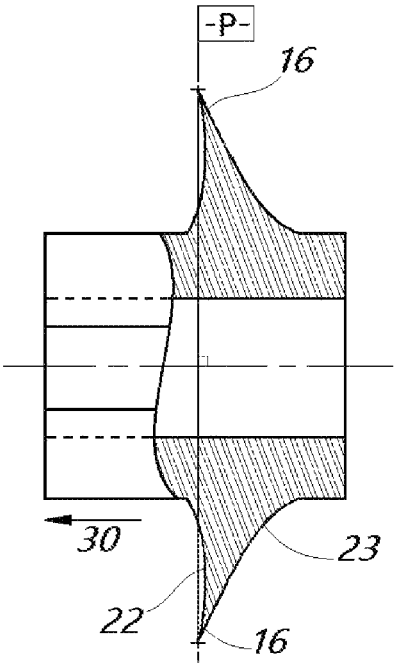
FIG. 4*c* shows a cross section of another alternative embodiment of a nose button in accordance with the invention.

FIG. 4*c* shows a cross section of another alternative embodiment of a nose button in accordance with the invention. The arrow [30] defines a "forward" direction along the longitudinal axis. The projections [16] have a forward rake angle in that their contours of projection arc forward as the projections extend radially. These projections each include a negatively curved forward facing spherical surface [22] and a conical rearward facing surface [23.] The forward facing spherical surfaces in this embodiment of each projection each have their own spherical center points; they are not common to other such surfaces on other projections. The tips of these projections are sharp points all residing in a plane [P] which is perpendicular to the longitudinal axis of the open seam tube.

Figure 5A:
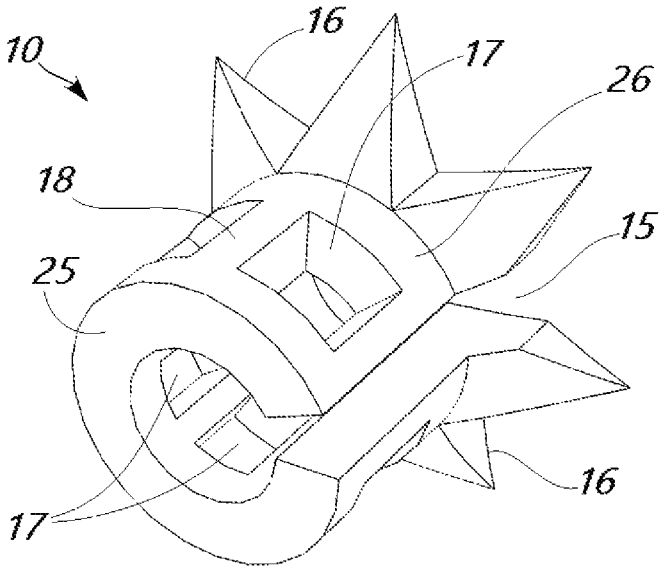
FIG. 5*a* shows another alternative embodiment of a nose button in accordance with the invention.

FIG. 5*a* shows another alternative embodiment of a nose button [10] in accordance with the invention and similar to the version shown in FIG. 3. This version includes an open seam tube defining a longitudinal axis and with a gap [15] running along its entire length. The tube further comprises a flared exterior surface which separates into a radially spaced array of radial projections [16,] with each projection further defining a contour of projection. This version also includes a radially spaced apart array of apertures [17] in the cylindrical section of the tube.

We may also describe this object as a bead comprising a first split ring [25] and a second split ring [26] connected by a plurality of connecting beams [18] spanning between the first and second split rings. The second split ring further comprises a radially spaced array of radial projections with each projection further defining a contour of projection, and with the ends of at least three of the projections, or preferably the ends of all such projections residing in a plane perpendicular to the longitudinal axis of the bead.

Figure 5B:
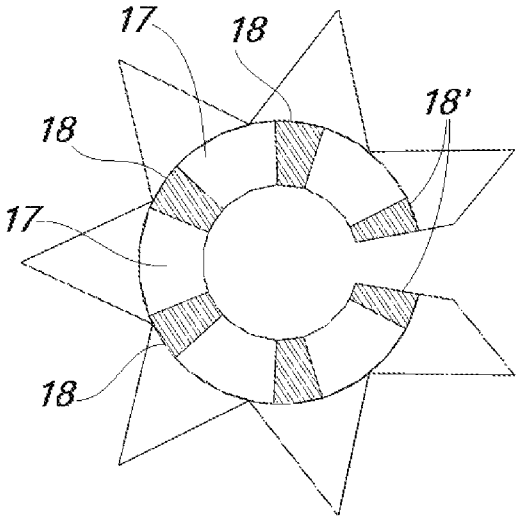
FIG. 5*b* shows a cross section of the embodiment of the nose button shown in FIG. 5*a*.

FIG. 5*b* shows a cross section of the embodiment of the nose button shown in FIG. 5*a* taken through its cylindrical portion having the radial apertures [17] punctuated by connecting beams [18.] The ends of the split rings each have a connecting beam [18'] which defines and bestrides the gap of the split which runs along the entire length of the bead.

Figure 6A:
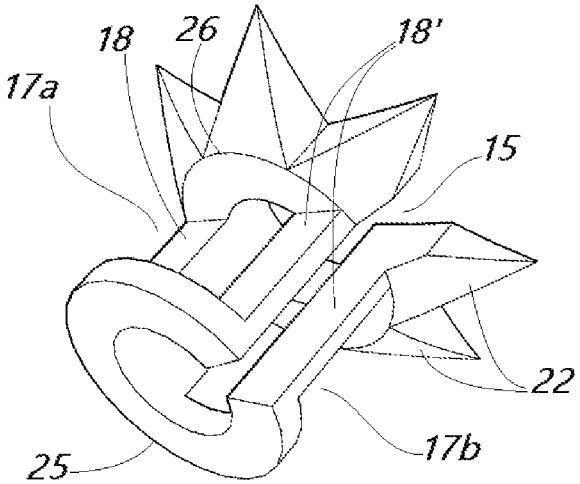
FIG. 6*a* shows an oblique front view of another alternative embodiment of a nose button in accordance with the invention.

FIG. 6*a* shows an oblique front view of another alternative embodiment of a nose button in accordance with the invention. In this embodiment the apertures [17*a*] and [17*b*] in the cylindrical portion of the tube are large and wide enough to leave only two locations for connecting beams between the first split ring [25] and the second split ring [26.] The locations for the connecting beams reside roughly diametrically opposite each other, with a first single connecting beam [18] opposite a pair of connecting beams [18'] which define and bestride the gap [15] of the split which runs along the entire length of the bead. This embodiment includes a radial array of tapering projections radially spaced around the rim of the second split ring, and these radial projection include forward facing positively curved spherical surfaces which in this embodiment are all concentric and of equal spherical radius. In other words, pairs of surfaces [22] may be found among the projections for which a first among the array of radial projections comprises a first positively curved spherical surface, and a surface of a second among the radial array of projections comprises a second positively curved spherical surface concentric to the first positively curved spherical surface.

Figure 6B:
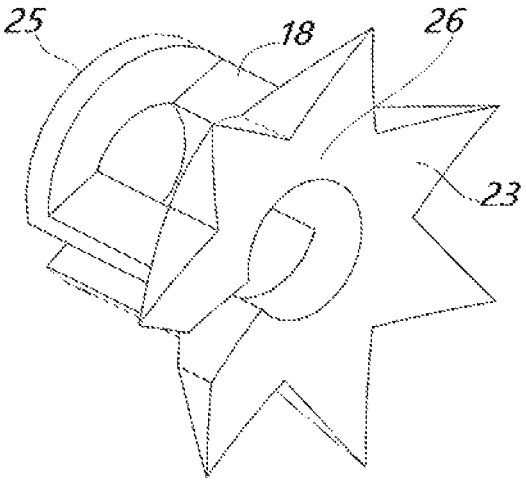
FIG. 6*b* shows an oblique rear view of the embodiment of the nose button of FIG. 6*a*.

FIG. 6*b* shows an oblique rear view of the embodiment of the nose button of FIG. 6*a*. The forward or first split ring [25] is connected to the second split ring [26] by connecting beams [18,] and the radial array of pointed projections share a common rearward facing spherical surface [23.] In other words, pairs of surfaces may be found among the projections for which a surface of a first among the array of radial projections comprises a first negatively curved spherical surface, and a surface of a second among the radial array of projections comprises a second negatively curved spherical surface concentric to the first negatively curved spherical surface.

Figure 7:
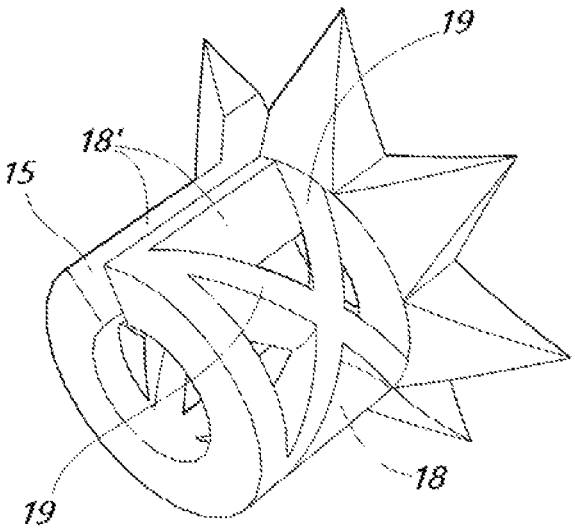
FIG. 7 shows another alternative embodiment of a nose button in accordance with the invention.

FIG. 7 shows another alternative embodiment of a nose button in accordance with the invention. The first and second split rings are connected by a primary connecting beam [18] in one location and, in another location diametrically opposite the first connecting beam, a pair of secondary connecting beams [18'] extend on both sides of the gap [15] in common with both the first and second split rings. Additional diagonal connecting beams [19] also extend along substantially helical paths to stabilize the first and second split rings. The connecting beams between the split rings may extend substantially parallel to the longitudinal axis bead, or they may comprise only helical structures so that the split rings are spaced apart by a longitudinally compressible arrangement. The plurality helical beams may be spaced apart to form a concentric series of springs of one wrap direction, or they may be arranged with at least one helical beam having a wrap direction opposed to at least one other helical beam so as to form one or more 'X' shaped junctions between the first and second split rings. These 'X' shaped junctions substantially increase the rigidity of the cylindrical tube portion of the bead.

Figure 8:
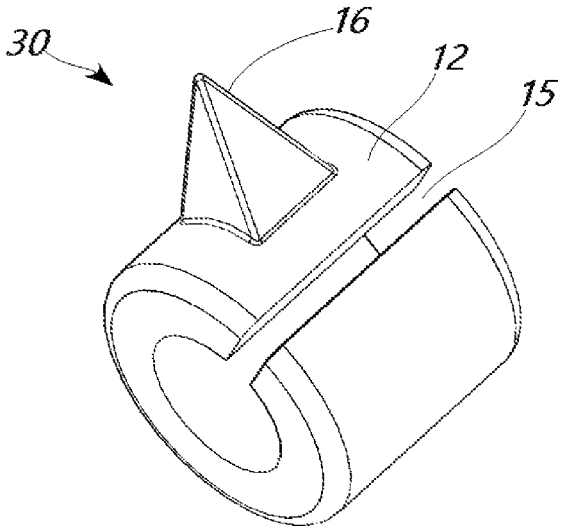
FIG. 8 shows yet another alternative embodiment of a nose button in accordance with the invention.

FIG. 8 shows yet another alternative embodiment of a nose button [30] in accordance with the invention, which is simple version fashioned with only one projection. An open seam tube [12] has a gap [15] running along its length. The tube defines a longitudinal axis and has at least one radial projection, but in the embodiment shown it has only one such projection. As discussed in FIGS. 4*a* and 4*b*, a projection inherently defining a contour of projection in general would include for example a curved tapering barb, and a straight line contour may be called an axis of projection, for projections which are pyramids, cylindrical stubs, or spikes. A plane plane perpendicular to the longitudinal axis of the open seam tube defines the tip of a projection as the point in the plane most distant from the axis. Any one of the projections may further comprise a cross section selected from the set of cross sections consisting of a circle, a square, a triangle, a polygon, and an ellipse.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. An open seam tube defining a longitudinal axis, said tube further comprising a radially spaced array of radial projections, with each said projection further defining a contour of projection, and with the tips of at least two of said projections residing in a plane perpendicular to said longitudinal axis.

2. The open seam tube of claim 1, wherein a portion of at least one of said radial projections tapers along its axis of projection.

3. The open seam tube of claim 1, wherein at least one of said radial projections comprises a cone.

4. The open seam tube of claim 1, wherein at least one of said radial projections terminates at an apex.

5. The open seam tube of claim 1, wherein at least one surface from among said radial projections comprises a positively curved spherical surface.

6. The open seam tube of claim 1, wherein a surface of a first among said array of radial projections comprises a first positively curved spherical surface, and a surface of a second among said radial array of projections comprises a second positively curved spherical surface concentric to said first positively curved spherical surface.

7. The open seam tube of claim 1, wherein a surface of a first among said array of radial projections comprises a first negatively curved spherical surface, and a surface of a second among said radial array of projections comprises a second negatively curved spherical surface concentric to said first negatively curved spherical surface.

8. The open seam tube of claim 1, further comprising at least one radial aperture.

9. A bead comprising a longitudinal axis, first and second split rings spaced apart along said axis, a plurality of connecting beams spanning between said first and second split rings, with said second split ring further comprising a radially spaced array of radial projections, with each projection further defining a contour of projection, and with the tips of at least two of said projections residing in a plane perpendicular to said longitudinal axis.

10. The bead of claim 9, wherein a portion of at least one projection tapers along its axis of projection.

11. The bead of claim 9, wherein at least one of said radial projections comprises a cone.

12. The bead of claim 9, wherein at least one of said radial projections terminates at an apex.

13. The bead of claim 9, wherein at least one surface among said radial array of projections comprises a positively curved spherical surface.

14. The bead of claim 9, wherein a surface of a first among said array of radial projections comprises a first positively curved spherical surface, and a surface of a second among said radial array of projections comprises a second positively curved spherical surface concentric to said first positively curved spherical surface.

15. The bead of claim 9, wherein a surface of a first among said array of radial projections comprises a first negatively curved spherical surface, and a surface of a second among said radial array of projections comprises a second negatively curved spherical surface concentric to said first negatively curved spherical surface.

16. The bead of claim 9, wherein a first connecting beam from among said plurality of connecting beams intersects a second connecting beam from among said plurality of connecting beams.

17. The bead of claim 9, wherein a connecting beam from among said plurality of connecting beams is a diagonal beam.

18. The bead of claim 9, wherein a connecting beam from among said plurality of connecting beams is a helical beam.

19. An open seam tube defining a longitudinal axis, said tube further comprising at least one radial projection, said projection further defining a contour of projection, and with a tip of said projection residing in a plane perpendicular to said longitudinal axis.

20. The open seam tube of claim 19, wherein any one of said projections further comprises a cross section selected from the set of cross sections consisting of a circle, a square, a triangle, a polygon, and an ellipse.

* * * * *